US007518957B2

(12) United States Patent
Sano

(10) Patent No.: US 7,518,957 B2
(45) Date of Patent: Apr. 14, 2009

(54) TIME-DATA TRANSMITTING APPARATUS AND TIME-CORRECTING SYSTEM

(75) Inventor: Takashi Sano, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 666 days.

(21) Appl. No.: 10/534,367

(22) PCT Filed: Dec. 9, 2003

(86) PCT No.: PCT/JP03/15740

§ 371 (c)(1),
(2), (4) Date: May 9, 2005

(87) PCT Pub. No.: WO2004/057428

PCT Pub. Date: Jul. 8, 2004

(65) Prior Publication Data

US 2006/0034159 A1 Feb. 16, 2006

(30) Foreign Application Priority Data

Dec. 19, 2002 (JP) ..... 2003-368110

(51) Int. Cl.
*G04C 11/02* (2006.01)

(52) U.S. Cl. ..... 368/47

(58) Field of Classification Search ..... 368/47, 368/10, 46

See application file for complete search history.

(56) References Cited

U.S. PATENT DOCUMENTS 5,537,101 A 7/1996 Nakajima et al.
6,219,302 B1 4/2001 Tanoguchi et al.
6,288,977 B1 * 9/2001 Yoshida et al. ..... 368/47
7,190,745 B2 * 3/2007 Takada et al. ..... 375/342

FOREIGN PATENT DOCUMENTS

| | | | |
|---|---|---|---|
| JP | 05142363 A | * | 6/1993 |
| JP | 11-316294 A | | 11/1999 |
| JP | 2000-075064 A | | 3/2000 |
| JP | 2000-241568 A | | 9/2000 |
| JP | 2000-241570 A | | 9/2000 |
| JP | 2000-329873 A | | 11/2000 |
| JP | 2002-156478 A | | 5/2002 |

OTHER PUBLICATIONS

Japanese Office Action (and English translation thereof) dated Feb. 12, 2008, issued in a counterpart Japanese Application.

* cited by examiner

*Primary Examiner*—Vit W Miska
(74) *Attorney, Agent, or Firm*—Frishauf, Holtz, Goodman & Chick, P.C.

(57) ABSTRACT

A relay device (30) receives a standard radio wave transmitted from a transmitting station (10) and containing time data, i.e. a time code. The device (30) transmits a relayed radio wave containing the time code received, at a first intensity. When the device (30) receives a transmission command code transmitted from a time-data receiving apparatus (50), it transmits the relayed radio wave for a predetermined time (10 minutes) at a second intensity that is lower than the first intensity. When a time-correction switch is operated, the time-data receiving apparatus (50) transmits a transmission command code to the relay device (30). The time-data receiving apparatus (50) receives the relayed radio wave transmitted at the second intensity from the relay device (30) in response to the command code and corrects the time on the basis of the time code it has received.

15 Claims, 9 Drawing Sheets

TIME-DATA TRANSMITTING APPARATUS AND TIME-CORRECTING SYSTEM

This application is a U.S. National Phase Application under 35 USC 371 of International Application PCT/JP2003/15740 filed Dec. 9, 2003.

TECHNICAL FIELD

The present invention relates to a time-data transmitting apparatus and a time-correcting system.

BACKGROUND ART

In Japan, two standard-time wave signals of 40 kHz and 60 kHz, each containing time data, i.e., a time code, are transmitted at present from two transmission stations (in Fukushima and Saga Prefectures). FIG. 9 shows the format of the time code contained in these standard-time wave signals.

The time code shown in FIG. 9 is transmitted every minute, in the form of a 60-second frame. The code has a start marker (M) that indicates the start time (i.e., the $0^{th}$ second of any minute) of the 60-second frame. The startmarker (M) has a pulse width of 0.2 seconds. The code also has position markers having a pulse width of 0.2 seconds. The position markers are arranged at the $9^{th}$ second (P1), the $19^{th}$ second (P2), the $29^{th}$ second (P3), the $39^{th}$ second (P4), the $49^{th}$ second (P5), and the $59^{th}$ second (P0), respectively. Thus, two markers, i.e., one start marker (M) and one position marker (P0), each having a pulse width of 0.2 seconds, are arranged at the boundary between any two adjacent frames. The start of a new frame can be recognized from these two markers. The start marker (M) is the frame reference marker (M). The leading edge of the pulse represented by the frame reference marker (M) is the accurate time of updating the minute-place of the current time. In the frame, the data items representing the minute, hour and day (counted from January 1), year (the lowest two digits of the Christian era), day of the week, and the like are arranged in the $0^{th}$ to $9^{th}$ second bracket, the $10^{th}$ to $19^{th}$ second bracket, and $30^{th}$ to $40^{th}$ second bracket, each in the form of binary-coded decimal numbers. In this case, logic 1 and logic 0 are represented by a pulse having a width of 0.5 seconds and a pulse having a width of 0.8 seconds, respectively. Note that the frame shown in FIG. 9 indicates the data representing 17:25 of the $114^{th}$ day of the year.

In recent years, so-called radio-wave clocks have come into practical use. A radio-wave clock receives a standard-time wave signal containing such a time code as described above. In the clock, the signal is used to correct the time data set in the time-measuring circuit. The radio-wave clock incorporates an antenna, which receives standard-time wave signals at predetermined intervals. Each signal received is amplified and modulated. The time code contained in the signal is decoded and used to correct the time data set in the time measuring circuit.

Electronic-wave clocks of this type are installed usually in rooms. If they are installed in steel-framed houses or in the basement, they cannot receive standard-time wave signals in many cases. To solve this problem, a system has been proposed, as disclosed in Jpn. Pat. Appln. Laid-Open Publication No. 2000-75064. In the system, a relay device is provided that receives standard-time wave signals and modulates the time code contained in each wave signal with a predetermined carrier wave, and transmits the wave signals each containing a modulated time code to the radio-wave clock. The time code is used to correct the time data set in the clock.

When the radio-wave clock is near the relay device, however, there layed wave signal it receives is too intensive. Therefore, the clock cannot receive the time code in normal way. Consequently, an error may occur in correcting the time data set in the radio-wave clock.

DISCLOSURE OF THE INVENTION

An object of this invention is to receive a radio wave in normal way from a relay device and to correct the time reliably in accordance with the time code contained in the radio wave. To achieve the object described above, a time-data transmitting apparatus according to this invention comprises: a transmission-demand signal receiving portion (37) which receives a weak-wave transmission-demand signal; and a transmission control portion (38, 39) which transmits a radio wave containing time data, at a predetermined time at a first intensity, and a radio wave containing the time data, at a second intensity lower than the first intensity, when the transmission-demand signal receiving portion (37) receives the weak-wave transmission-demand signal.

The time-data transmitting apparatus according to the present invention can transmit radio waves each containing a time code, at the first intensity. When it receives a weak-wave transmission-demand signal, it can transmit the radio wave containing a time code, at the second intensity that is lower than the first intensity. This makes it possible to correct the time in any nearby radio-wave clock.

BEST MODE FOR CARRYING OUT THE INVENTION

Embodiments of the present invention will be described in detail, with reference to the accompanying drawings.

Figure 1:
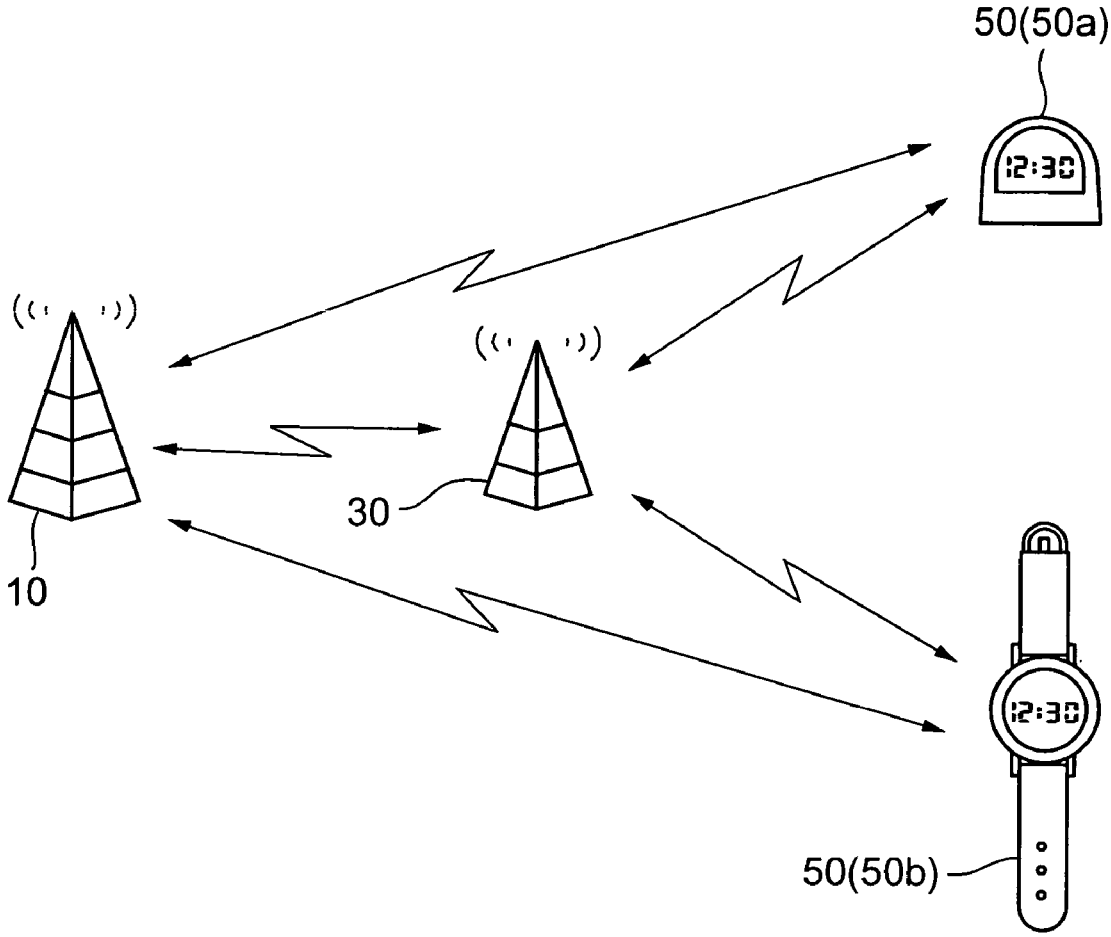
FIG. 1 is a diagram showing a time-correcting system.

FIG. 1 shows a time-correcting system 1 according to the present invention.

As FIG. 1 shows, the time-correcting system 1 comprises mainly a transmitting station 10, a relay device 30, and so-called radio-wave clocks 50. The transmitting station 10 transmits a standard radio wave containing a time code (hereinafter called "standard time code") that represents the standard time. The relay device 30 receives the standard radio wave from the transmitting station 10 and measures the current time from the standard radio wave. Then, the relay device 30 transmits a radio wave (hereinafter called "relayed radio wave") that contains the time code (hereinafter called "relayed time code") read from the standard radio wave. The radio-wave clocks 50 (hereinafter referred to as "time-data receiving apparatuses") are, for example, a table clock 50*a* or/and a wristwatch 50*b,* which receive the standard radio wave from the transmitting station 10 and correct the time.

The relay device 30 is configured to receive the standard radio wave transmitted from the station 10, measures the current time from the standard radio wave and transmits the relayed radio wave at a predetermined electric-field intensity (hereinafter referred to as "first intensity"). The relay device 30 may receive a transmission-start command code (i.e., weak-wave transmission-demand signal) transmitted from the time-data receiving apparatuses 50. Alternatively, a switch, for example, may be operated to change the electric-field intensity at which to transmit the relayed radio wave. In either case, the relay device 30 transmits the relayed radio wave for a prescribed time at an electric-field intensity (hereinafter referred to as "second intensity") that is lower than the first intensity.

The time-data receiving apparatuses 50 are configured to communicate with the relay device 30. They receive the relayed radio wave transmitted from the relay device 30 if they cannot receive the standard radio wave transmitted from the station 10 for a time longer than a predetermined time. The time-data receiving apparatuses 50 measure and correct the current time in accordance with the relayed radio wave received. When the switch is operated, for example, to correct the time, the receiving apparatuses 50 transmit the transmission-start command code to the relay device 30. Upon receipt of the command code, the relay device 30 transmits the relayed radio wave. The receiving apparatuses 50 receive the relayed radio wave and measure and correct the current time in accordance with the relayed radio wave.

The range over which the transmission-start command code is transmitted will be described. As described above, the shorter the distance between the time-data receiving apparatuses 50 and the relay device 30, the higher electric-field intensity at which the receiving apparatuses 50 receive the relayed radio wave. When the distance decreases to a predetermined distance, the time-data receiving apparatuses 50 can no longer receive the relayed radio wave in normal way. The predetermined distance is the longest range over which the transmission-start command code transmitted from the time-data receiving apparatuses 50 can be received by the relay device 30. This range is the range of transmission for the transmission-start command code. Hence, the relay device 30 receives the transmission-start command code when the time-data receiving apparatuses 50 cannot receive the relayed radio wave in normal way.

A first embodiment of this invention will be described with reference to FIG. 2 to 5.

The structure of the first embodiment will be described first.

Figure 2:
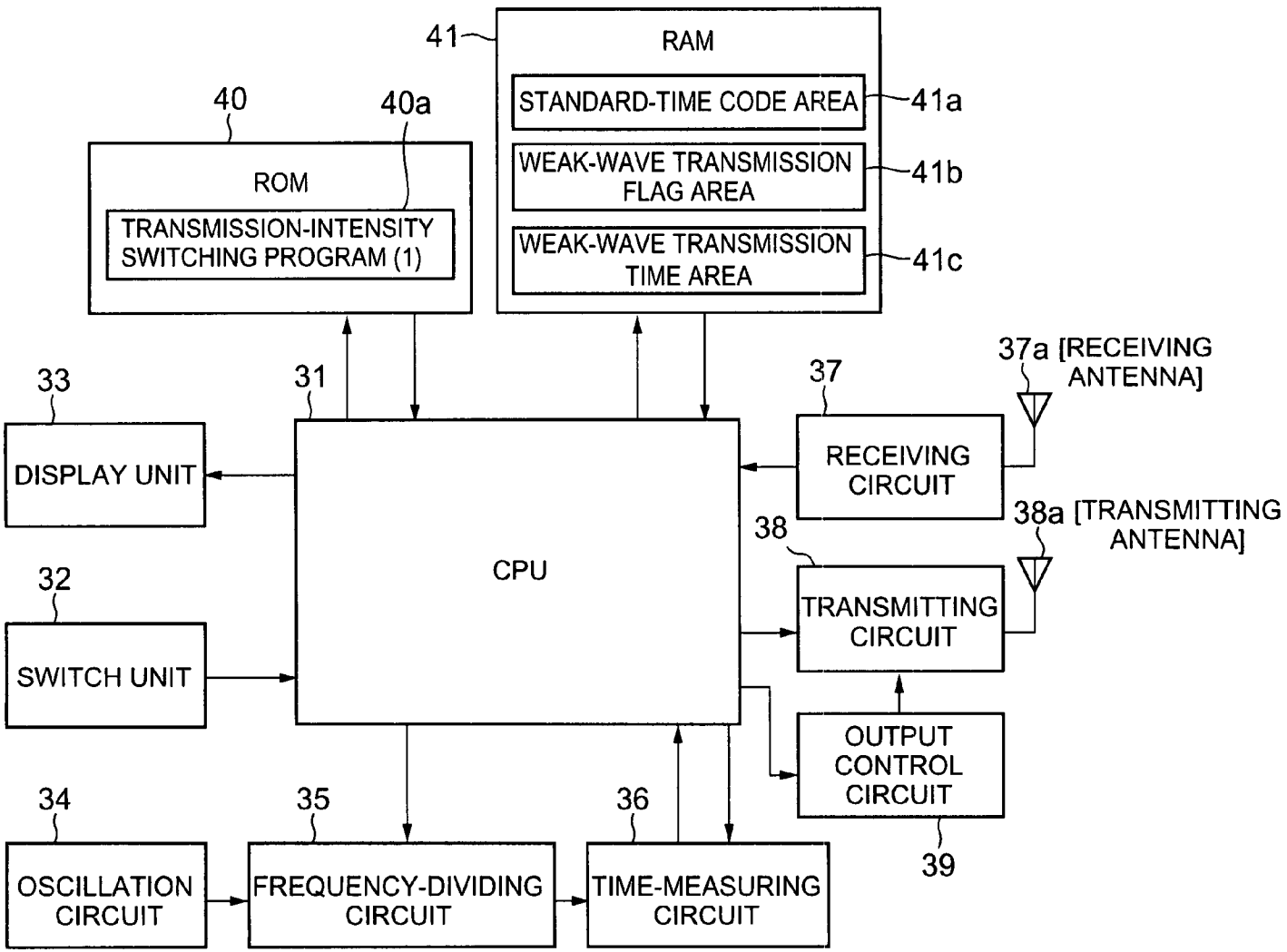
FIG. 2 is a block diagram illustrating the internal structure of a relay device shown in FIG. 1.

FIG. 2 is a block diagram illustrating the internal structure of a relay device 30 for use in the first embodiment.

As FIG. 2 shows, the relay device 30 comprises a CPU 31, a switch unit 32, a display unit 33, an oscillation circuit 34, a frequency-dividing circuit 35, a time-measuring circuit 36, a receiving circuit 37, a receiving antenna 37*a,* a transmitting circuit 38, a transmitting antenna 38*a,* an output control circuit 39, a ROM 40, and a RAM 41.

In response to an operation signal or the like input at a prescribed time or from the switch unit 32, the CPU 31 reads various programs from the ROM 40 and writes them into the RAM 41. The CPU 31 then executes processes in accordance with the programs, thereby to control the other components of the relay device 30. Particularly in the first embodiment, the CPU 31 executes the transmission-intensity switching process (1) (see FIG. 4) in accordance with the transmission-intensity switching program (1) 40*a* stored in the ROM 40.

The switch unit 32 comprises various switches including a forced-switching switch that is manually operated to change the transmission intensity of the relayed radio wave from the first intensity to the second intensity. When operated, the switches generate operation signals. The operation signals are output to the CPU 31.

The display unit 33 is a display such as an LCD (Liquid Crystal Display) or the like. It displays the current time in digits, in response to a display signal supplied from the CPU 31.

The oscillation circuit 34 comprises, for example, a quartz oscillator. It outputs a clock signal of a constant frequency to the frequency-dividing circuit 35 at all times.

The frequency-dividing circuit 35 counts the pulses of the clock signal input from the oscillation circuit 34. Every time the circuit 35 counts a number of pulses that corresponds to one minute, it outputs a one-minute signal to the time-measuring circuit 36.

The time-measuring circuit 36 counts the one-minute signals input from the frequency-dividing circuit 35, thereby generating current-time data that represents the current date and the hour, minute and second of the current time. The CPU 31 corrects, if necessary, the current-time data generated in the time-measuring circuit 36, on the basis of the standard time code.

The receiving circuit 37 may receive, via the receiving antenna 37*a,* the standard radio wave transmitted from the transmitting station 10 in response to an instruction or the like input from the CPU 31. The circuit 37 may receive, via the receiving antenna 37*a,* a transmission-start command code transmitted from any time-data receiving apparatus 50. In either case, the receiving circuit 37 detects and extracts a signal of a predetermined frequency from the signal it has received.

When the receiving circuit 37 receives the standard radio wave, it extracts the standard time code from the extracted signal of the predetermined frequency. The standard time code contains data items necessary for the time-measuring function. These data items are a standard-time code, an accumulated-day code, a day-of-week code, and the like. The standard time code is output to the CPU 31. The receiving circuit 37 outputs a transmission-start signal to the CPU 31 when it receives the transmission-start command code.

The transmitting circuit 38 receives a relay time code from the CPU 31 and adds it to the carrier wave, thus providing a relay radio wave. The relay radio wave is transmitted from the transmitting circuit 38 via the transmitting antenna 38*a.*

The output control circuit 39 controls the electric-field intensity of the relay radio wave to be transmitted from the transmitting circuit 38 via the transmitting antenna 38*a,* in accordance with an intensity-switching signal input from the CPU 31. More precisely, the circuit 39 controls the electric-field intensity at the first intensity (i.e., normal output) or at the second intensity that is lower than the first intensity.

The ROM 40 stores not only various initial set values and initial programs, but also programs and data that enable the relay device 30 to perform various functions. Particularly in the first embodiment, the ROM 40 stores the transmission-intensity switching program (1) 40*a.*

The RAM 41 has a data-storage area for temporarily storing various programs to be executed by the CPU 31, data to be used in executing these programs, and the like. Particularly in the first embodiment, the RAM 41 has a standard-time code area 41*a* for holding the standard time code, a weak-wave transmission flag area 41*b* for holding a weak-wave transmission flag, and a weak-wave transmission time area 41*c* for holding a weak-wave transmission time.

The weak-wave transmission flag is a flag that indicates the intensity of the relay radio wave. More specifically, this flag is set at "0" to transmit the relay radio wave at the first intensity, and at "1" to transmit the relay radio wave at the second intensity.

The weak-wave transmission time is the time that elapses from the start of the transmission of the relay radio wave at the second intensity. The data representing the weak-wave transmission time is stored in units of minutes, in the weak-wave transmission time area 41*c*.

Figure 3:
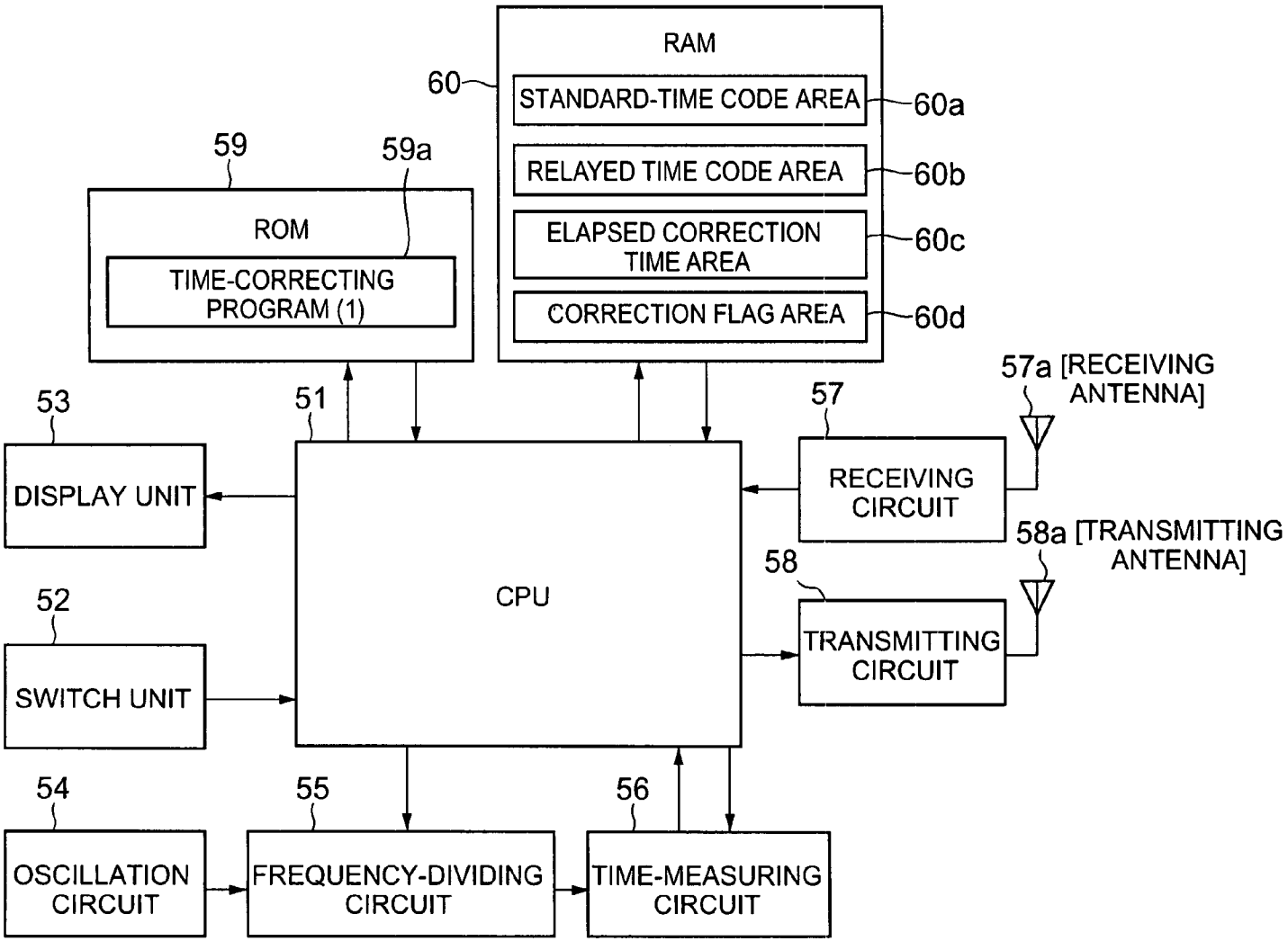
FIG. 3 is a block diagram depicting the internal structure of each time-data receiving apparatus shown in FIG. 1.

FIG. 3 is a block diagram depicting the internal structure of each time-data receiving apparatus 50 used in the first embodiment.

As FIG. 3 shows, each time-data receiving apparatus 50 comprises a CPU 51, a switch unit 52, a display unit 53, an oscillation circuit 54, a frequency-dividing circuit 55, a time-measuring circuit 56, a receiving circuit 57, a receiving antenna 57*a*, a transmitting circuit 58, a transmitting antenna 58*a*, a ROM 59, and a RAM 60.

In response to an operation signal input at a prescribed time or from the switch unit 52, the CPU 51 reads various programs from the ROM 59 and writes them into the RAM 60. The CPU 51 then executes processes in accordance with the programs, thereby to control the other components of the time-data receiving apparatuses 50. Particularly in the first embodiment, the CPU 51 executes the time-correcting process (1) (see FIG. 5) in accordance with the time-correcting program (1) 59*a* stored in the ROM 59.

The switch unit 52 comprises various switches including a time-correcting switch that is manually operated to start the time correction that is performed on the basis of the relayed radio wave. When operated, the switches generate operation signals. The operation signals are output to the CPU 51.

The display unit 53 is a display such as an LCD (Liquid Crystal Display) or the like. It displays the current time in digits, in response to a display signal supplied from the CPU 51.

The oscillation circuit 54 comprises, for example, a quartz oscillator. It outputs a clock signal of a constant frequency to the frequency-dividing circuit 55 at all times.

The frequency-dividing circuit 55 counts the pulses of the clock signal input from the oscillation circuit 54. Every time the circuit 55 counts a number of pulses that corresponds to one minute, it outputs a one-minute signal to the time-measuring circuit 56.

The time-measuring circuit 56 counts the one-minute signals input from the frequency-dividing circuit 55, thereby generating current-time data that represents the current date and the hour, minute and second of the current time. The CPU 51 corrects, if necessary, the current-time data generated in the time-measuring circuit 56, on the basis of the standard time code or the relayed time code.

The receiving circuit 57 may receive, via the receiving antenna 57*a*, the standard radio wave transmitted from the transmitting station 10 in response to an instruction or the like input from the CPU 51. The circuit 57 may receive, via the receiving antenna 57*a*, the relayed radio wave transmitted from the relay device 30. In either case, the receiving circuit 57 detects and extracts a signal of a predetermined frequency from the signal it has received.

When the receiving circuit 57 receives the standard radio wave or the relayed radio wave, it extracts the standard time code or relayed time code from the extracted signal of the predetermined frequency. The standard time code or the relayed time code contains data items necessary for the time-measuring function. These data items are a standard-time code, an accumulated-day code, a day-of-week code, and the like. The standard time code or the relayed time code is output to the CPU 51.

The transmitting circuit 58 receives a transmission-start signal from the CPU 51 and adds it to the carrier wave, thus providing a transmission-start command code. The transmission-start command signal is transmitted via the transmitting antenna 58*a*.

The ROM 59 stores not only various initial set values and initial programs, but also programs and data that enable the time-data receiving apparatus 50 to perform various functions. Particularly in the first embodiment, the ROM 59 stores the time-correcting program (1) 59*a*.

The RAM 60 has a data-storage area for temporarily storing various programs to be executed by the CPU 51, data to be used in executing these programs, and the like. Particularly in the first embodiment, the RAM 60 has a standard-time code area 60*a* for holding the standard time code, a relayed time code area 60*b* for holding the relayed time code, an elapsed correction time area 60*c* for holding an elapsed correction time, and a correction flag area 60*d* for holding a correction flag.

The elapsed correction time is the time that has elapsed from the previous time correction achieved in accordance with the standard radio wave. It is stored in units of hours, in the elapsed correction time area 60*c*.

The correction flag is a flag that indicates whether the time should be corrected on the basis of the relayed radio wave. That is, it indicates whether or not the relayed radio wave must be received. More specifically, this flag is set at "1" if the relayed radio wave should be received, and at "0" if the relayed radio wave need not be received.

The operation of the first embodiment will be described.

Figure 4:
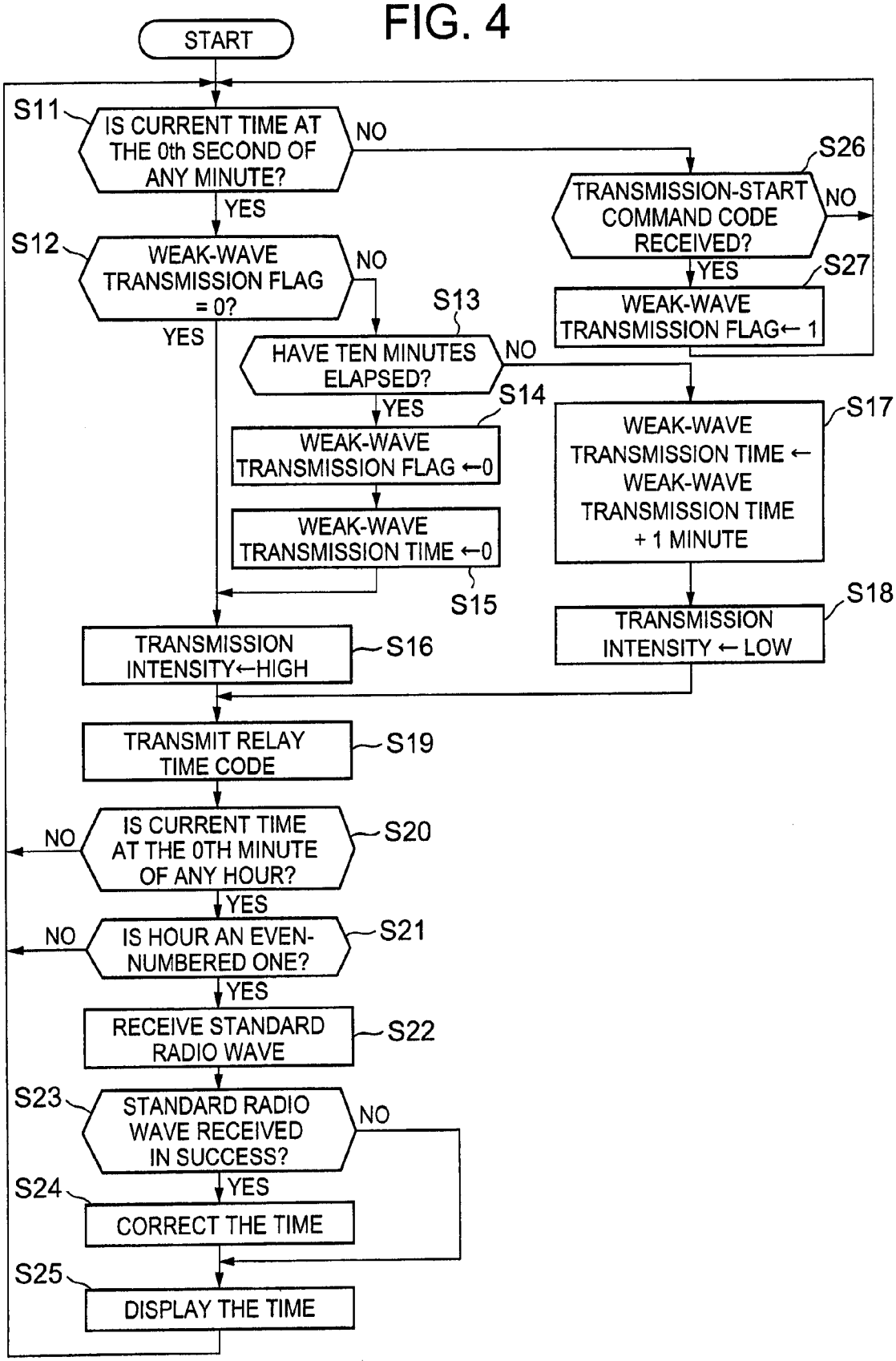
FIG. 4 is a flowchart explaining how the relay device operates in a first embodiment of the invention.

FIG. 4 is a flowchart explaining how the relay device 30 operates in the first embodiment. The relay device 30 operates under the control of the CPU 31 in accordance with the transmission-intensity switching program (1) 40*a* that is stored in the ROM 40.

As FIG. 4 shows, the CPU 31 monitors the current-time data generated by the time-measuring circuit 36. If it is determined that the current time is at the $0^{th}$ second of any minute (Step S11: YES), the CPU 31 determines whether the weak-wave transmission flag is set at "0" or not. If the weak-wave transmission flag is set at "0" (Step S12: YES), the CPU 31 outputs an intensity-switching signal to the output control circuit 39. The transmission intensity for the relayed radio wave is set at the "first intensity" (Step S16).

If the weak-wave transmission flag is set at "1" (Step S12: NO), it is determined whether the time for transmitting a weak radio wave is "10" or not, that is, whether or not ten minutes have passed from the start of transmitting the relay radio wave at the second intensity. If ten minutes have passed (Step S13; YES), the CPU 31 sets the weak-wave transmission flag to "0" (Step S14). The CPU 31 updates the weak-wave transmission time to "0" (Step S15). The CPU 31 then outputs an intensity-switching signal to the output control circuit 39, thereby setting the transmission intensity for the relayed radio wave to the "first intensity" (Step S16).

The weak-wave transmission time may be less than "10," that is ten minutes have not passed since the start of transmission of the relay radio wave at the second intensity (Step S13: NO). In this case, the CPU 31 updating the weak-wave transmission time, adding "one minute" to the weak-wave transmission time (Step S17). Then, the CPU 31 outputs an intensity-switching signal to the output control circuit 39, thereby setting the transmission intensity for the relayed radio wave to the "second intensity" (Step S18).

After setting the transmission intensity for the relayed radio wave in accordance with the weak-wave transmission flag, the CPU 31 performs a process to transmit a relayed time code. That is, it generates a relay time code from the current-time data generated by the time-measuring circuit 36 and outputs the relay time code to the transmitting circuit 38 (Step S19). The transmitting circuit 38 transmits, via the transmitting antenna 38*a*, the relayed radio wave containing the relay time code at the transmission intensity thus set.

Next, the CPU 31 determines whether the current time is at the $0^{th}$ minute of any hour, from the current-time data generated by the time-measuring circuit 36. If the current time is found to be at the $0^{th}$ minute of the hour (Step 20: YES), the CPU 31 determines whether the hour is an even-numbered one or not. If the hour is found to be an even-numbered one (Step S21: YES), the CPU 31 executes a process to receive the standard radio wave (Step S22). If the relay device 30 receives the standard radio wave in (Step S23: YES), the current-time data generated by the time-measuring circuit 36 is corrected on the basis of the standard time code contained in the standard radio wave received (Step S24). Thereafter, the CPU 31 executes a process, causing the display unit 33 to display the current time thus corrected (Step S25). The operation then returns to Step S11.

The current time may be found not to be at the $0^{th}$ second of any minute (Step S11: NO). In this case, the CPU 31 determines whether the relay device 30 has received a transmission-start command code. If it is determined that the relay device 30 has received a transmission-start command code (Step S26: YES), the CPU 31 sets the weak-wave transmission flag to "1" (Step S27). The operation then returns to Step S11.

Figure 5:
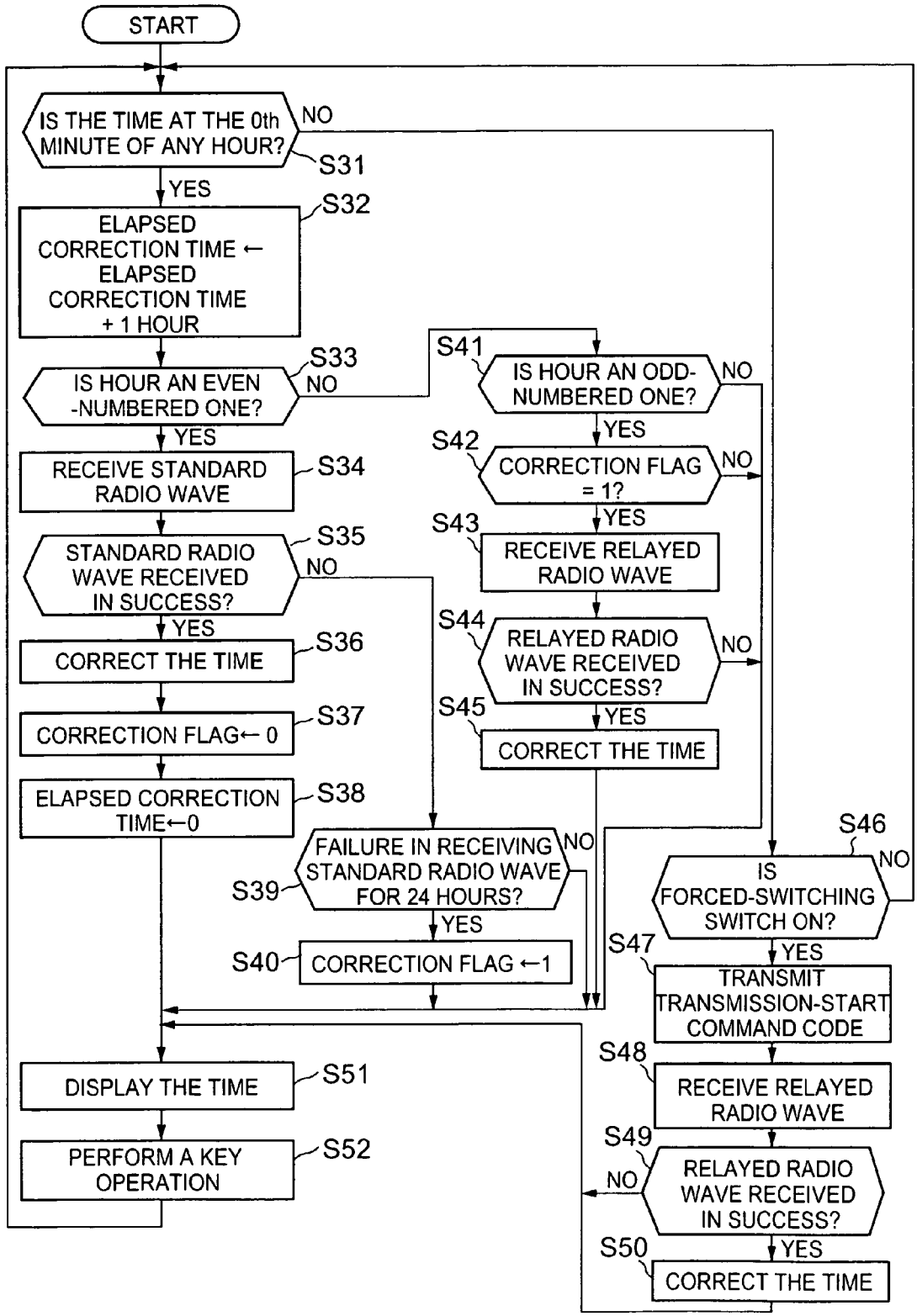
FIG. 5 is a flowchart explaining how the time-data receiving apparatus operates in the first embodiment.

FIG. 5 is a flowchart explaining how each time-data receiving apparatus 50 operates in the first embodiment. The time-data receiving apparatus 50 operates under the control of the CPU 51 in accordance with the time-correcting program (1) 59*a* that is stored in the ROM 59.

As FIG. 5 shows, the CPU 51 monitors the current-time data generated by the time-measuring circuit 56. If it is determined that the current time is at the $0^{th}$ minute of any hour (Step S31: YES), the CPU 51 updates the elapsed correction time, adding "one hour" to the elapsed correction time (Step S32). Then, the CPU 51 determines whether the hour is an even-numbered one or not (Step S33). If the hour is found to be an even-numbered one (Step S33: YES), the CPU 51 executes the following sequence of steps, every two hour.

First, the CPU 51 executes a process to receive the standard radio wave (Step S34). If the time-data receiving apparatus 50 receives the standard radio wave in success (Step S35: YES), the current-time data generated by the time-measuring circuit 56 is corrected on the basis of the standard time code contained in the standard radio wave received (Step S36). Then, the CPU 51 sets the correction flag to "0" (Step S37) and updates the elapsed correction time to "0" (Step S38).

The time-data receiving apparatus 50 may fail to receive the standard radio wave in success (Step S35: NO). In this case, the CPU 51 determines how long the elapsed correction time is. If the elapsed correction time has reached "24," or if the time has not been corrected for 24 hours on the basis of the standard radio wave (Step S39: YES), the CPU 51 sets the correction flag to "1" (Step S40).

If the hour is found not to be an even-numbered one (Step S33: NO), the CPU 51 determines whether the hour is an odd-numbered one or not. If the hour is an odd-numbered one (Step S41: YES), the CPU 51 determines whether the correction flag is set to "1." If the correction flag is set to "1" (Step S42: YES), the CPU 51 executes a process to receive the relayed radio wave (Step S43). If the time-data receiving apparatus 50 receives the relayed radio wave in success (Step S44: YES), the current-time data generated by the time-measuring circuit 56 is corrected on the basis of the relayed time code contained in the relayed radio wave received (Step S45).

Next, the CPU 51 executes a process, causing the display unit 53 to display the current time that has been corrected on the basis of the standard radio wave or the relayed radio wave (Step S51). The CPU 51 then performs a key process in accordance with operation signals input from the switch unit 52. If the CPU 51 receives an operation signal from the time-correcting switch included in the switch unit 52, it turns on the forced-switching switch also included in the switch unit 52 (Step S52). The operation then returns to Step S31.

If the current time is found not to be at the $0^{th}$ minute of any hour (Step S31: NO), the CPU 51 determines whether the forced-switching switch is ON. If the forced-switching switch is found to be "ON" (Step S46: YES), the CPU 51 executes a process to transmit a transmission-start command-code. That is, the CPU 51 outputs a transmission-start command signal to the transmitting circuit 58, causing the transmitting circuit 58 to transmit a transmission-start command code based on the transmission-start command signal via the transmitting antenna 58*a* (Step S47).

Thereafter, the CPU 51 executes a process to receive the relayed radio wave (Step S48). If the time-data receiving apparatus 50 receives the relayed radio wave in success (Step S49: YES), the current-time data generated by the time-measuring circuit 56 is corrected on the basis of the standard time code contained in the relayed radio wave received (Step S50). Then, the CPU 51 performs a process to display the time, causing the display unit 53 to display the current time that has been corrected (Step S51). Further, the CPU 51 then performs a key process in the same way as indicated above (Step S52). The operation then returns to Step S31.

In the first embodiment, the relay device 30 transmits the relayed radio wave at the first intensity and monitors the receipt of a transmission-start command code, as has been described above. When the relay device 30 receives a transmission-start command code, it can transmit the relayed radio wave at the second intensity lower than the first intensity, for ten minutes.

Each time-data receiving apparatus 50 receives the standard radio wave and the relayed radio wave alternately, every hour. It corrects the time on the basis of the time code received. It also determines whether the time-correcting switch has been operated or not. When the time-correction switch is operated, the time-data receiving apparatus 50 transmits a transmission-start command code and receives the relayed radio wave at the second intensity. It then corrects the time in accordance with the time code received.

Hence, each time-data receiving apparatus 50 can receive the relayed radio wave at a weakened electric-field intensity when the time-correction switch is operated. It can therefore correct the time with accuracy.

A second embodiment of this invention will be described with reference to FIG. 6 to 8.

The second embodiment is characterized in that the relay device and each time-data receiving apparatus have a switch that can be operated by a user. When the switch provided on the relay device is operated, the relay device switches the electric-field intensity for the relayed radio wave, form the first intensity to the second intensity. When the switch provided on each time-data receiving apparatus is operated, the time-data receiving apparatus can receive a relayed radio wave at the second intensity.

Figure 6A:
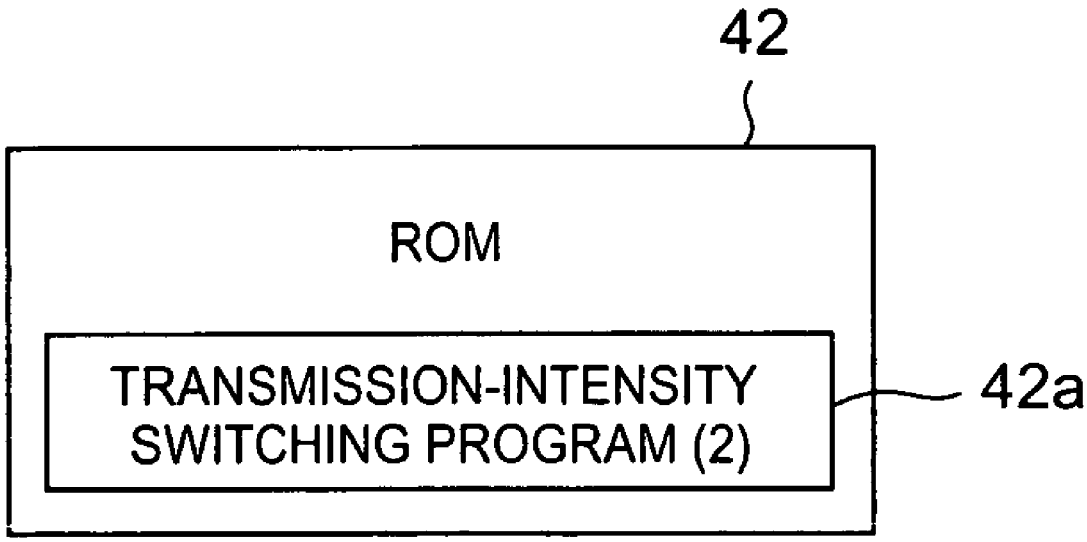
FIGS. 6A and 6B are diagrams illustrating two ROMs, respectively, which are incorporated in the relay device and time-data receiving apparatus of a second embodiment of the invention.

The relay device of the second embodiment differs from that of the first embodiment, in that ROM 42 shown in FIG. 6A is used in place of the ROM 40 shown in FIG. 2. Each time-data receiving apparatus differs from that of the first embodiment, in that ROM 61 is used in place of the ROM 59 depicted in FIG. 3. The components identical to those of the first embodiment are designated at the same reference numerals and will not be described in detail.

Figure 6B:
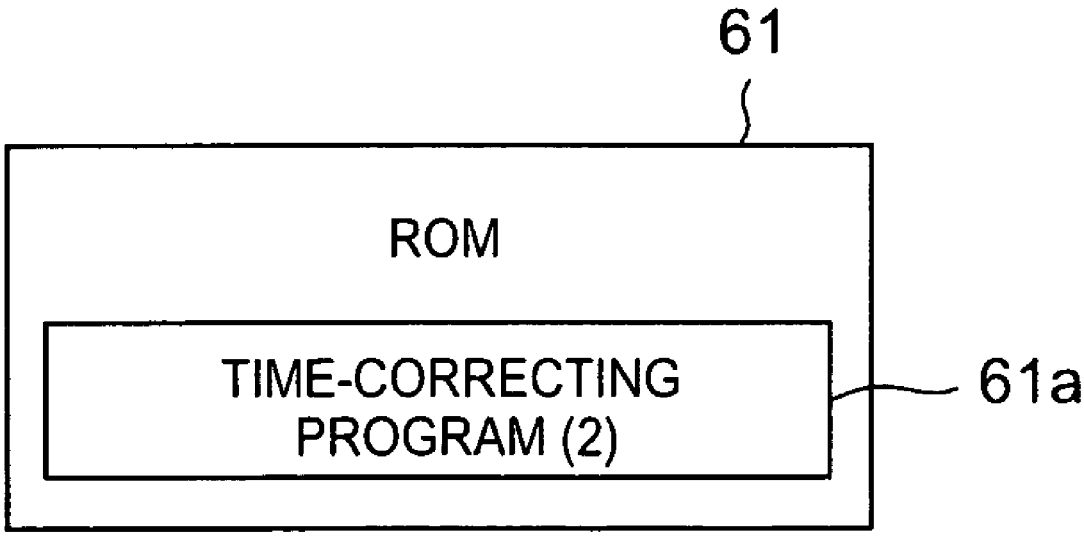

FIG. 6A is a diagram illustrating the ROM 42 incorporated in the relay device of the second embodiment. FIG. 6B is a diagram showing the ROM 61 incorporated in each time-data receiving apparatus of the second embodiment. The ROM 42 stores a transmission-intensity switching program (2) 42*a*. The ROM 61 stores a time-correcting program (2) 61*a*.

The operation of the second embodiment will be described.

Figure 7:
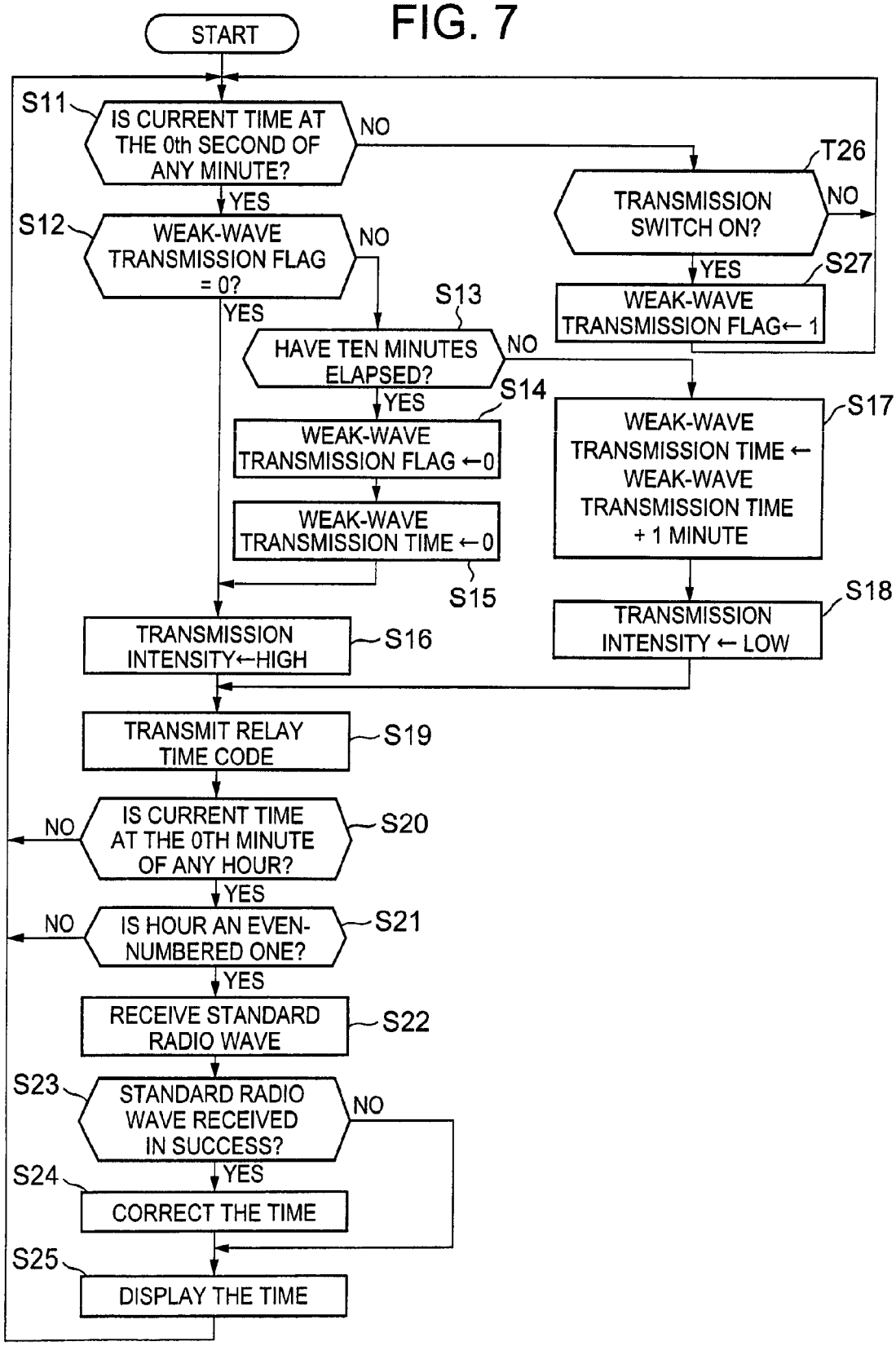
FIG. 7 is a flowchart explaining how the relay device operates in the second embodiment of the invention.

FIG. 7 is a flowchart explaining how the relay device 30 operates in the second embodiment. The relay device 30 operates under the control of the CPU 31 in accordance with the transmission-intensity switching program 42*a*that is stored in the ROM 42. The steps identical to those shown in FIG. 4 (first embodiment) are designated at the same step notations (i.e., step numbers) and will not be explained. Only the steps different will be mainly described.

As FIG. 7 shows, if the CPU 31 determines that the current time is not at the $0^{th}$ second of any minute (Step S11: NO), it will determine whether the forced-switching switch has been operated. If the forced-switching switch is operated and the switch unit 32 generates an operation signal (Step T26: YES), the CPU 31 sets the weak-wave transmission flag to "1" (Step S27). The operation then returns to Step S11.

Figure 8:
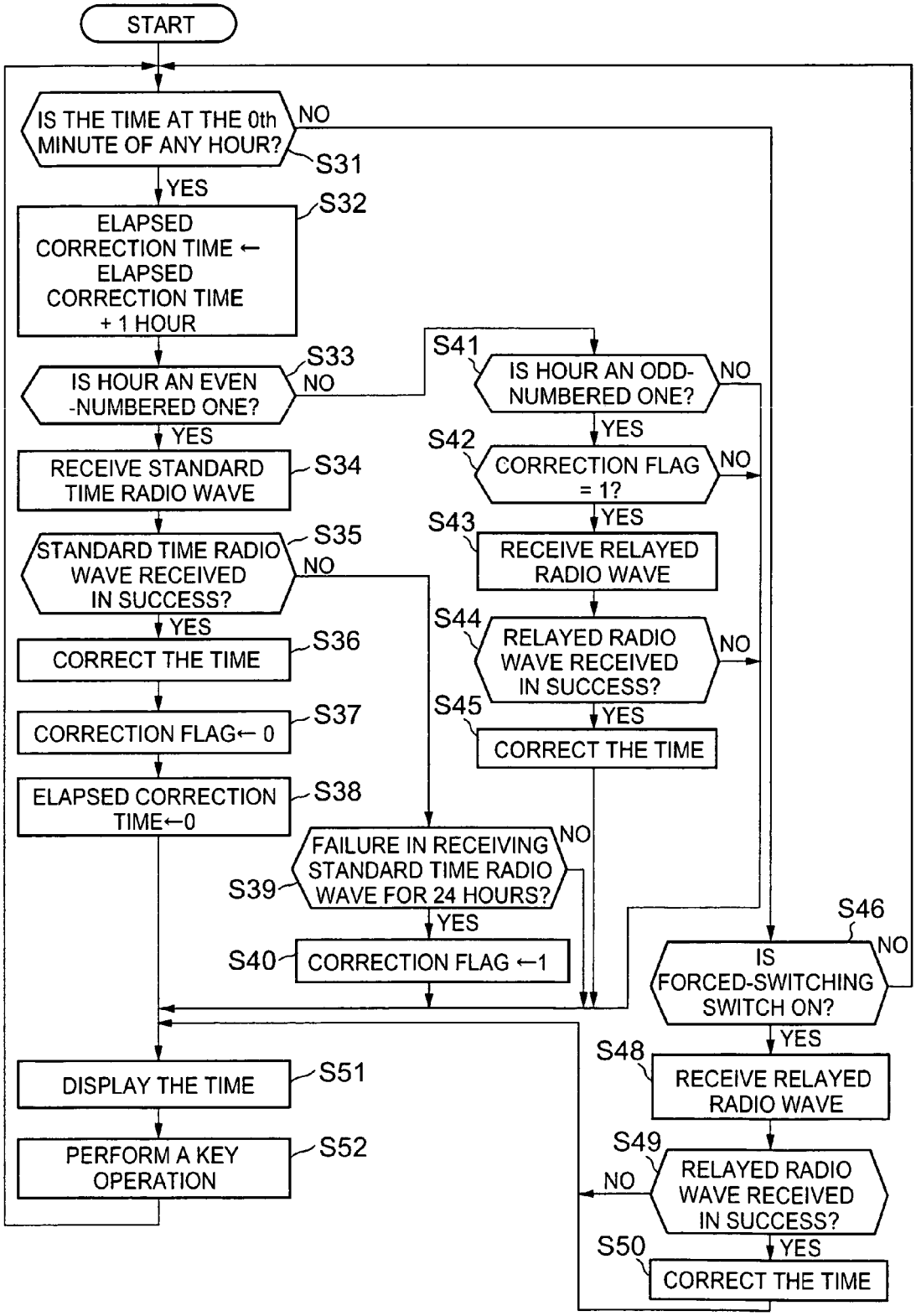
FIG. 8 is a flowchart explaining how the time-data receiving apparatus operates in the second embodiment.
Figure 9:
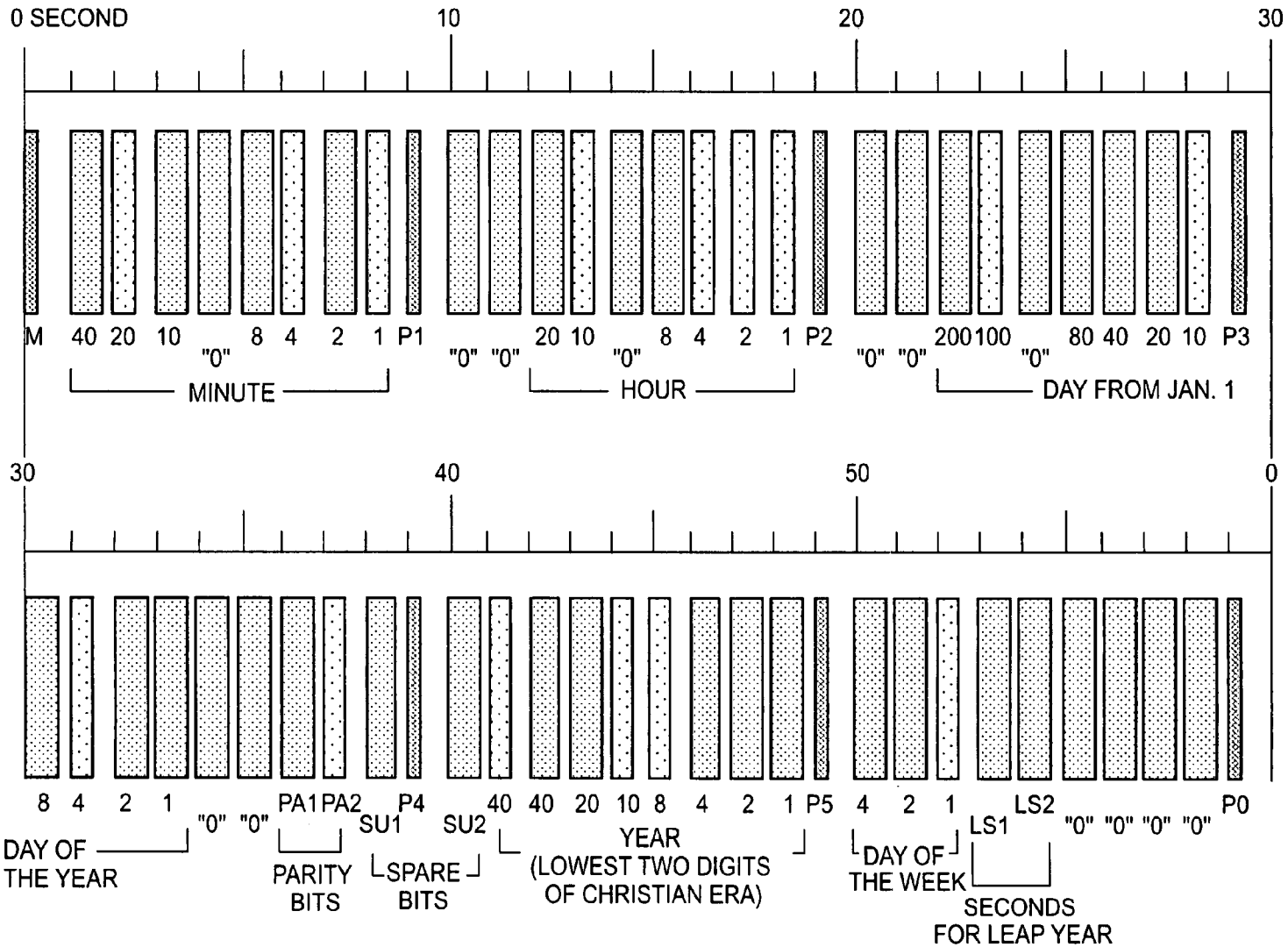
FIG. 9 is a diagram representing the format of a time code.

FIG. 8 is a flowchart explaining how each time-data receiving apparatus 50 operates in the second embodiment. The time-data receiving apparatus 50 operates under the control of the CPU 51 in accordance with the time-correcting program 61*a*that is stored in the ROM 61. The steps identical to those shown in FIG. 5 (first embodiment) are designated at the same step notations (i.e., step numbers) and will not be explained. Only the steps different will be mainly described.

As FIG. 8 depicts, if it is determined in Step S31 that the current time is not at the $0^{th}$ minute of any hour (Step S31: NO), the CPU 51 determines whether the forced-switching switch is ON. If the forced-switching switch is found to be ON (Step S46: YES), the CPU 51 executes a process to receive the relayed radio wave.

If the time-data receiving apparatus 50 receives the relayed radio wave in success (Step S49: YES), the CPU 51 corrects the current-time data generated by the time-measuring circuit 56, on the basis of the standard time code contained in the relayed radio wave received (Step S50). Then, the CPU 51 performs a process to display the time, causing the display unit 53 to display the current time that has been corrected (Step S51). Further, the CPU 51 then performs a key process in the same way as indicated above (Step S52). The operation then returns to Step S31.

In the second embodiment, the relay device 30 transmits the relayed radio wave at the first intensity and monitors the operation of the forced-switching switch, as has been described above. When the forced-switching switch is operated, the relay device 30 transmits the relayed radio wave at the second intensity lower than the first intensity, for ten minutes.

Each time-data receiving apparatus 50 receives the standard radio wave and the relayed radio wave alternately, every hour. It corrects the time on the basis of the time code received. It also determines whether the time-correcting switch has been operated or not. When the time-correction switch is operated, the time-data receiving apparatus 50 receives the relayed radio wave and then corrects the time in accordance with the time code received.

Hence, each time-data receiving apparatus 50 can receive the relayed radio wave at a weakened electric-field intensity when the forced-switching switch of the relay device 30 and the time-correction switch of the time-data receiving apparatus 50 are operated. The receiving apparatus 50 can therefore correct the time with accuracy.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2002-368110 filed on Dec. 19, 2002 and including specification, claims, drawings and summary. The disclosure of the above Japanese Patent Application is incorporated herein by reference in its entirety.

The invention claimed is:

1. A time-data transmitting apparatus comprising:

a time-measuring portion which measures current time data;

a radio-wave reception control portion which receives a standard-time radio wave signal containing time data;

a time-correcting portion which corrects the current time data measured by the time-measuring portion based on the time data contained in the standard-time radio wave signal received by the radio-wave reception control portion;

a transmission-demand signal reception control portion which receives a weak-wave transmission-demand signal; and a transmission control portion which transmits a radio wave containing time data based on the current time data measured by the time-measuring portion, at a predetermined time and at a first intensity, and which, for a predetermined time period, halts transmission of the radio wave containing the time data at the first intensity and performs transmission thereof at a second intensity that is lower than the first intensity, when the transmission-demand signal reception control portion receives the weak-wave transmission-demand signal.

2. The time-data transmitting apparatus according to claim 1, wherein the weak-wave transmission-demand signal is transmitted from a wristwatch.

3. The time-data transmitting apparatus according to claim 1, wherein the time data contained in the radio wave represents time in minimum units of minutes.

4. The time-data transmitting apparatus according to claim 1, wherein the predetermined time has a one-minute interval.

5. The time-data transmitting apparatus according to claim 1, wherein the radio wave transmitted from the transmission control portion is of a same frequency and same format as the standard-time radio wave signal.

6. The time-data transmitting apparatus according to claim 1, wherein at least one of a frequency and a format of the radio wave transmitted from the transmission control portion differs from that of the standard-time radio wave signal.

7. A time-data transmitting apparatus comprising:

an external operation switch; and a transmission control portion which transmits a radio wave containing time data, at a predetermined time and at a first intensity, and which, for a predetermined time period, halts transmission of the radio wave containing the time data at the first intensity and performs transmission thereof at a second intensity that is lower than the first intensity, when the external operation switch is operated.

8. The time-data transmitting apparatus according to claim 7, further comprising:

a time-measuring portion which measures current time data;

a standard radio-wave receiving portion which receives a standard-time radio wave signal containing time data; and a time-correcting portion which corrects the current time data measured by the time-measuring portion, based on the time data contained in the standard-time radio wave signal received by the standard radio-wave receiving portion, wherein the transmission control portion transmits the radio wave that contains the time data based on the current time data measured by the time-measuring portion.

9. The time-data transmitting apparatus according to claim 7, wherein the time data contained in the radio wave represents time in minimum units of minutes.

10. The time-data transmitting apparatus according to claim 7, wherein the predetermined time has a one-minute interval.

11. The time-data transmitting apparatus according to claim 8, wherein the radio wave transmitted from the transmission control portion is of a same frequency and same format as the standard-time radio wave signal.

12. The time-data transmitting apparatus according to claim 8, wherein at least one of a frequency and a format of the radio wave transmitted from the transmission control portion differs from that of the standard-time radio wave signal.

13. A time-correcting system comprising:

(i) a time-data transmitting apparatus which comprises:

a time-measuring portion which measures current time data;

a radio-wave reception control portion which receives a standard-time radio wave signal containing time data;

a time-correcting portion which corrects the current time data measured by the time-measuring portion based on the time data contained in the standard-time radio wave signal received by the radio-wave reception control portion;

a transmission-demand signal reception control portion which receives a weak-wave transmission-demand signal; and a transmission control portion which transmits a radio wave containing time data based on the current time data measured by the time measuring portion, at a predetermined time and at a first intensity, and which, for a predetermined time period, halts transmission of the radio wave containing the time data at the first intensity and performs transmission thereof at a second intensity that is lower than the first intensity, when the transmission-demand signal reception control portion receives the weak-wave transmission-demand signal, and (ii) a clock which comprises:

a time-measuring portion which measures current time;

a transmission-demand transmitting portion which transmits the weak-wave transmission-demand signal;

a wave-receiving portion which receives a radio wave that is transmitted from the time-data transmitting apparatus and that contains a time code; and a time-correcting portion which corrects the time based on the time code received by the wave-receiving portion.

14. The time-correcting system according to claim 13, wherein the clock further comprises a standard radio-wave receiving portion which receives the standard-time radio wave signal containing the time data, and wherein the time-correcting portion for the clock further corrects the current time measured by the time-measuring portion based on the time data contained in the standard-time radio wave signal received by the standard radio-wave receiving portion.

15. The time-correcting system according to claim 13, wherein the clock comprises a band for strapping the clock on the arm of a user.

* * * * *